US009119012B2

(12) United States Patent
Ikizyan et al.

(10) Patent No.: US 9,119,012 B2
(45) Date of Patent: Aug. 25, 2015

(54) LOUDSPEAKER BEAMFORMING FOR PERSONAL AUDIO FOCAL POINTS

(75) Inventors: Ike Ikizyan, Newport Coast, CA (US); Wilf LeBlanc, Vancouver (CA)

(73) Assignee: Broadcom Corporation, Irvine, CA (US)

( * ) Notice: Subject to any disclaimer, the term of this patent is extended or adjusted under 35 U.S.C. 154(b) by 466 days.

(21) Appl. No.: 13/536,193

(22) Filed: Jun. 28, 2012

(65) Prior Publication Data

US 2014/0003622 A1 Jan. 2, 2014

(51) Int. Cl.

| | |
|---|---|
| ***H04R 29/00*** | (2006.01) |
| ***H04S 7/00*** | (2006.01) |
| ***H04R 3/00*** | (2006.01) |
| *H04R 1/40* | (2006.01) |

(52) U.S. Cl.

CPC *H04S 7/303* (2013.01); *H04R 3/00* (2013.01); *H04S 7/301* (2013.01); *H04R 1/403* (2013.01); *H04R 2203/12* (2013.01)

(58) Field of Classification Search

CPC ..... H04R 29/00; H04R 3/00; H04R 29/001; H03G 3/00

USPC ..... 381/93, 95, 58–59, 103, 83, 105, 77, 381/79–80

See application file for complete search history.

(56) References Cited

U.S. PATENT DOCUMENTS

| | | | | |
|---|---|---|---|---|
| 6,674,865 | B1 | 1/2004 | Venkatesh et al. | |
| 6,954,538 | B2 * | 10/2005 | Shiraishi | 381/105 |
| 7,117,145 | B1 | 10/2006 | Venkatesh et al. | |
| 7,526,093 | B2 * | 4/2009 | Devantier et al. | 381/59 |
| 7,577,260 | B1 | 8/2009 | Hooley et al. | |
| 7,606,377 | B2 | 10/2009 | Melanson | |
| 7,606,380 | B2 | 10/2009 | Melanson | |
| 7,676,049 | B2 | 3/2010 | Melanson | |
| 7,804,972 | B2 | 9/2010 | Melanson | |
| 7,826,624 | B2 | 11/2010 | Oxford | |
| 7,970,150 | B2 | 6/2011 | Oxford | |
| 7,991,167 | B2 | 8/2011 | Oxford | |
| 8,090,117 | B2 | 1/2012 | Cox | |
| 8,111,830 | B2 | 2/2012 | Moon et al. | |
| 8,160,268 | B2 | 4/2012 | Horbach | |
| 8,184,180 | B2 | 5/2012 | Beaucoup | |
| 8,275,136 | B2 * | 9/2012 | Niemisto et al. | 381/58 |
| 2004/0208324 | A1 | 10/2004 | Cheung et al. | |
| 2007/0263845 | A1 | 11/2007 | Hodges et al. | |
| 2008/0069378 | A1 * | 3/2008 | Rabinowitz et al. | 381/103 |
| 2008/0226087 | A1 * | 9/2008 | Kinghorn | 381/59 |
| 2009/0238383 | A1 | 9/2009 | Meyer et al. | |
| 2009/0252355 | A1 | 10/2009 | Mao | |
| 2009/0316918 | A1 * | 12/2009 | Niemisto et al. | 381/58 |
| 2010/0026780 | A1 | 2/2010 | Tico et al. | |

(Continued)

OTHER PUBLICATIONS

Yamaha Sound Bar/Digital Sound Projector, http://usa.yamaha.com/products/audio-visual/hometheater-systems/digital-sound-projector/, Copyright 2012.

*Primary Examiner* — Disler Paul

(74) *Attorney, Agent, or Firm* — McDermott Will & Emery LLP

(57) ABSTRACT

In one embodiment, a method comprising receiving at a microphone located at a first location audio received from plural speakers, the audio received at a first amplitude level; and responsive to moving the microphone away from the first location to a second location, causing adjustment of the audio provided by the plural speakers to target the first amplitude level at the microphone.

20 Claims, 5 Drawing Sheets

(56) References Cited

U.S. PATENT DOCUMENTS

| | | | | |
|---|---|---|---|---|
| 2011/0002469 | A1 | 1/2011 | Ojala | |
| 2011/0038229 | A1 | 2/2011 | Beaucoup | |
| 2011/0091055 | A1 | 4/2011 | Leblanc | |
| 2011/0096915 | A1 | 4/2011 | Nemer et al. | |
| 2011/0129095 | A1* | 6/2011 | Avendano et al. | 381/63 |
| 2011/0164141 | A1 | 7/2011 | Tico et al. | |
| 2011/0178798 | A1 | 7/2011 | Flaks et al. | |
| 2011/0301730 | A1 | 12/2011 | Kemp et al. | |
| 2012/0076306 | A1 | 3/2012 | Aarts et al. | |
| 2012/0093344 | A1 | 4/2012 | Sun et al. | |
| 2012/0120270 | A1 | 5/2012 | Li et al. | |

* cited by examiner

LOUDSPEAKER BEAMFORMING FOR PERSONAL AUDIO FOCAL POINTS

TECHNICAL FIELD

The present disclosure is generally related to audio processing.

BACKGROUND

Recent wireless video transmission standards such as WirelessHD allow mobile devices such as tablets and smartphones to transmit rich multimedia from a user's hand to audio/video (A/V) resources in a room, such as a big screen and surround speakers. Current challenges include providing a satisfactory presentation of multimedia to interested users without interfering with the enjoyment of others.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
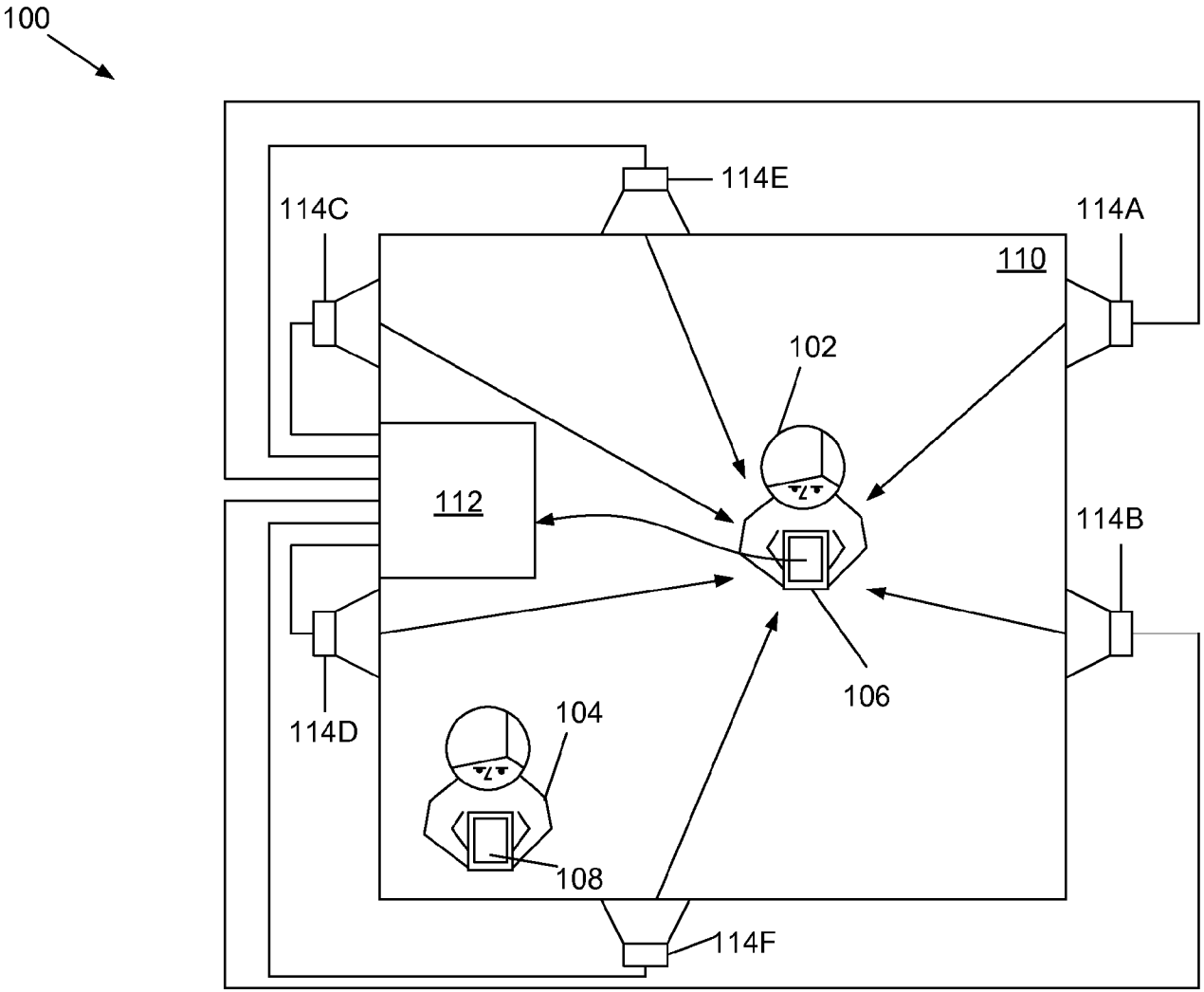
FIG. 1 is a block diagram of an example environment in which an embodiment of a personal audio beamforming system may be employed.

Disclosed herein are certain embodiments of a personal audio beamforming system and method that apply adaptive loudspeaker beamforming to focus audio energy coming from multiple loudspeakers such that the audio is perceived loudest at the location of a user and quieter elsewhere in a room. In one embodiment, a personal audio beamforming system may use adaptive loudspeaker beamforming in conjunction with a mobile sensing microphone residing in a mobile device, such as a smartphone, tablet, laptop, among other mobile devices with wireless communication capabilities.

For instance, tablets and smartphones typically have a microphone and audio signal processing capabilities. In one embodiment, an adaptive filtering algorithm (e.g., least means squares (LMS), recursive least squares (RLS), etc.) may be implemented in the mobile device to control the matrixing of multiple-channel audio being transmitted over a WirelessHD, or similar, transmission channel. In one embodiment, an adaptive feedback control loop may continually balance the phasing of the channels such that an audio amplitude sensed at the microphone input of the mobile device is optimized (e.g., maximized) while creating nulls or lower amplitude audio elsewhere in the room.

One or more benefits that inure through the use of one or more embodiments of a personal audio beamforming system include isolation of at least some of the audio from others in the room (e.g., prevent or mitigate disturbance by the user's audio to others in the room). In addition, or alternatively in some embodiments, a personal audio beamforming system may permit multiple users in a room to share loudspeaker resources and to hear their individual audio source with reduced crosstalk. Also, in some embodiments, there may be power savings realized through implementation of a personal audio beamforming system, since power is focused primarily in the desired direction, rather than in undesired directions.

In contrast, existing systems may have a one-time set-up to optimize the beam without further modification once initiated for a fixed listening position. Such limited adaptability may result in user dissatisfaction. In one or more embodiments of a personal audio beamforming system, the beam is continually adapted based on the signal characteristics as the position of the mobile device is moved, and in turn, the audio amplitude is optimized for the device of a user.

Having summarized certain features of an embodiment of a personal audio beamforming system, reference will now be made in detail to the description of the disclosure as illustrated in the drawings. While the disclosure will be described in connection with these drawings, there is no intent to limit it to the embodiment or embodiments disclosed herein. Further, although the description identifies or describes specifics of one or more embodiments, such specifics are not necessarily part of every embodiment, nor are all various stated advantages necessarily associated with a single embodiment or all embodiments. On the contrary, the intent is to cover all alternatives, modifications and equivalents included within the spirit and scope of the disclosure as defined by the appended claims. Further, it should be appreciated in the context of the present disclosure that the claims are not necessarily limited to the particular embodiments set out in the description.

Referring to FIG. 1, shown is a block diagram of an example environment 100 in which an embodiment of a personal audio beamforming system may be employed. The depicted environment 100 includes a room 110 occupied by two users 102 and 104, each having in their possession a mobile device 106, 108. The room 110 may be part of a residential building (e.g., home, apartment, etc.), or part of a commercial or recreational facility. The mobile devices 106, 108 are each equipped with one or more microphones to receive audio signals, as well as transmitter functionality to communicate with other devices. The mobile devices 106, 108 may be configured as smartphones, cell phones, laptops, tablets, among other types of well-known mobile devices. As shown in FIG. 1, the mobile devices 106 and 108 communicate with a media device 112. Such communication may be via wired and/or wireless technologies. The media device 112 may be an audio receiver/amplifier, set-top box, television, media player (e.g., DVD, CD), or other media or multimedia electronic system. The media device 112 is coupled to a plurality of speakers 114 (e.g., 114A-114F), the latter providing a surround sound experience, such as based on Dolby, THX (e.g., 5.1, 6.1, 7.1, etc.), among others well-known in the art. It should be appreciated within the context of the present disclosure that the environment 100 depicted in FIG. 1 is one example illustration, and that some environments may include a single user or additional users with respective one or more mobile devices, wherein one or more of the users are interested or uninterested in the audio content received by the other mobile devices.

In one example operation, the mobile device 106 may be equipped with a wireless HDMI interface to project multimedia such as audio and/or video (e.g., received wirelessly or over a wired connection from a media source) to the media device 112. The media device 112 is equipped to process the signal and play back the video (e.g., on a display device, such as a computer monitor or television or other electronic appliance display screen) and play back the audio via the speakers 114. The microphone of the mobile device 106 is equipped to detect the audio from the speakers 114. The mobile device 106 may be equipped with feedback control logic, which extracts and/or computes signal statistics or parameters (e.g., amplitude, phase, etc.) from the microphone signal and makes adjustments to decoded source audio to cause the audio emanating from the speakers 114 to interact constructively, destructively, or a combination of both at the input to the microphone in a manner to ensure the microphone receives the audio at or proximal to a defined target level (e.g., highest or optimized audio amplitude) regardless of the location of the mobile device 106 in the room 110. In other words, as the user 102 traverses the room 110, the feedback control logic (whether embodied in the mobile device 106 or the media device 112) continually adjusts the decoded source audio to target a desired (e.g., optimal, maximum, etc.) amplitude at the input to the microphone of the mobile device 106.

In some embodiments, the mobile device 108 may also have a microphone to cause a nulling or attenuation of the audio to ensure the user 104 is not disturbed (or not significantly disturbed) by the audio the user 102 is enjoying. For instance, in one example operation, the mobile device 108 may indicate (e.g., as prompted by input by the user 104) to the mobile device 106 whether or not the user 104 is interested in audio content destined for the user 102. The mobile device 108 may transmit to the mobile device 106 statistics about the signal (and/or transmit the signal or a variation thereof) received by the microphone of the mobile device 108 to appropriately direct the control logic of the personal audio beamforming system (e.g., of the mobile device 106) to achieve the stated goals (e.g., boost the signal when the user 104 is interested in the audio or null the signal when disinterested). Assume the user 104 is not interested in the content (desired by the user of the mobile device 106) to be received by the mobile device 108. In such a circumstance, the mobile device 108 may try to distinguish a portion of the received signal amplitude contributed by the unwanted content sourced by the mobile device 106. If the mobile device 108 is not transmitting audio, then such a circumstance represents a simple case of the reception of unwanted audio. However, if the mobile device 108 is transmitting its own audio content, then in one embodiment, the mobile device 108 may estimate the expected audio signal envelope by analyzing it own content transmission and subtract the envelope (corresponding to the desired audio content) from an envelope of the signal detected (which includes the desired audio as well as the unwanted audio from the mobile device 106) by its microphone. Based on a residual envelope the mobile device 108 may estimate crosstalk signal strength. In other words, the mobile device 108 may determine how much unwanted signal power is received by subtracting off the desired content to be heard. The mobile device 108 may signal to the mobile device 106 information corresponding to the unwanted signal power to enable by the mobile device 106 a de-emphasizing of the spectrum corresponding to the unwanted audio signal power to achieve a nulling of the unwanted content at the microphone of the mobile device 108. Other mechanisms to remove the unwanted signal contribution are contemplated to be within the scope of the disclosure.

In some embodiments, source audio reception and processing (e.g., decode, encode, etc.) may be handled at the media device 112, where the mobile device 106 handles microphone input and feedback adjustments. In some embodiments, the mobile device 106 may only handle the microphone reception and communicate parameters of the signal (and/or the signal) to the media device 112 for further processing. Other variations are contemplated to be within the scope of the disclosure.

In some embodiments, the personal audio beamforming system may be comprised of all components shown in FIG. 1, and in some embodiments, the personal audio beamforming system may comprise a subset thereof, or additional components in some embodiments.

Figure 2:
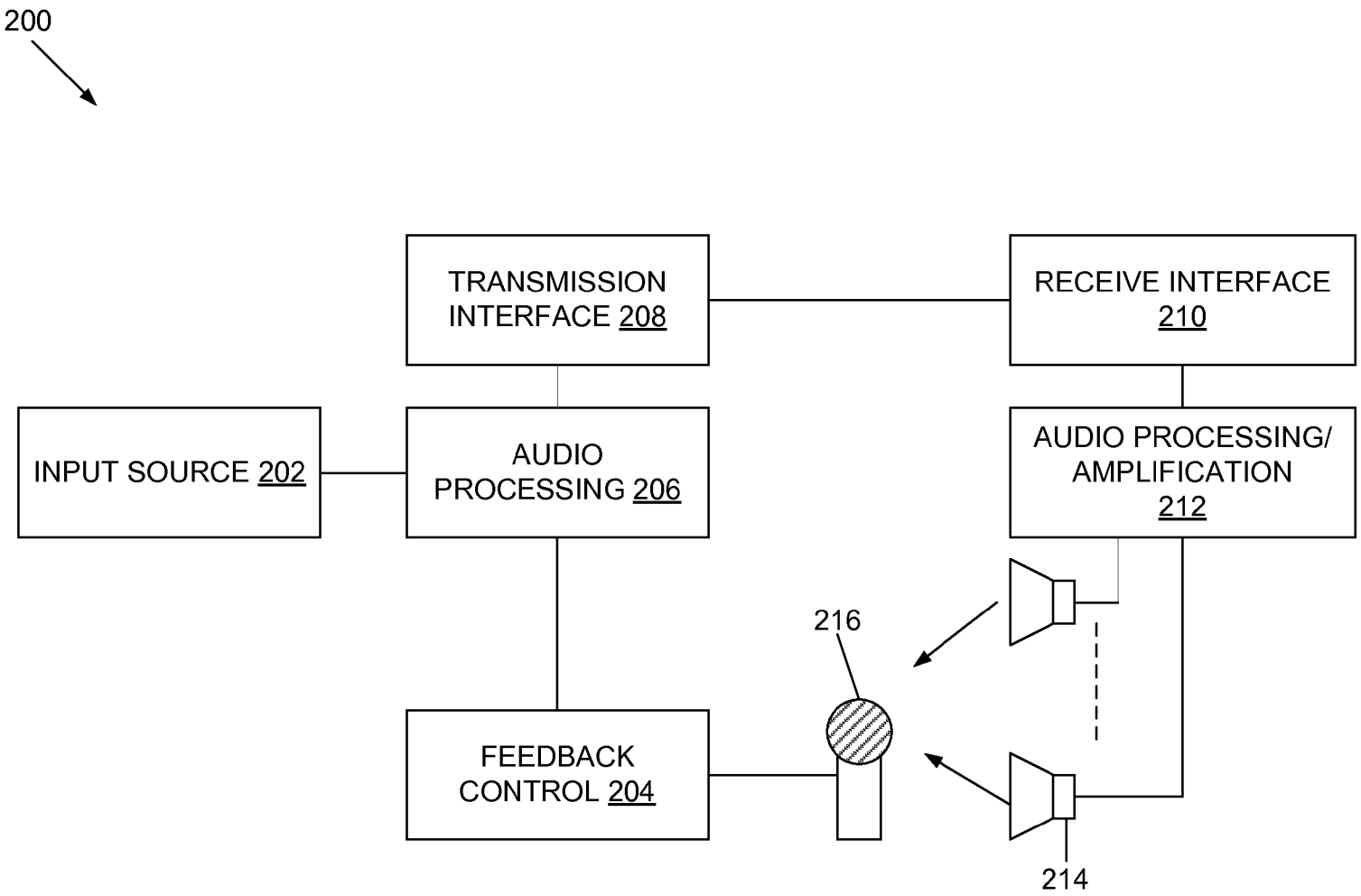
FIG. 2 is a block diagram generally depicting an example embodiment of a personal audio beamforming system.

Having described an example environment in which certain embodiments of a personal audio beamforming system may be employed, attention is directed now to FIG. 2, which provides a block diagram that generally depicts an embodiment of a personal audio beamforming system 200. One having ordinary skill in the art should appreciate in the context of the present disclosure that the example personal audio beamforming system 200 depicted in FIG. 2 is for illustrative purposes, and that other variations are contemplated to be within the scope of the disclosure. The personal audio beamforming system 200 receives source audio from input source 202. In some embodiments, the input source 202 may be part of the personal audio beamforming system 200, such as a media player, and in some embodiments, the input source 202 may represent an input connection, such as a wired or wireless connection for receiving media (e.g., audio, as well as in some embodiments video, graphics, etc.) over a wired or wireless connection. The personal audio beamforming system 200 also comprises feedback control logic 204, audio processing logic 206, transmission interface logic 208, receive interface logic 210, audio processing/amplification logic 212, plural speakers, such as speaker 214, and one or more microphones, such as microphone 216. Note that reference herein to logic includes hardware, software, or a combination of hardware and software.

The audio processing logic 206 may include decoding and encoding functionality. For instance, the audio processing logic 206 decodes the sourced audio, providing the decoded audio to the feedback control logic 204. The feedback control logic 204 processes (e.g., modifies the amplitude and/or phase delay) of the decoded audio and provides the processed audio over plural channels. Audio encoding functionality of the audio processing logic 206 encodes the adjusted audio and provides a modified audio bitstream to the transmission interface logic 208. The transmission interface logic 208 may be embodied as a wireless audio transmitter (or transceiver in some embodiments) equipped with one or more antennas to wirelessly communicate the modified audio bitstream to the receive interface 210. In some embodiments, the transmission interface logic 208 may be a wired connection, such as where a mobile device (e.g., mobile device 106) is plugged into a media device 112 (FIG. 1), or in some embodiments where the audio processing logic 206 resides in the media device 112 and the mobile device 106 (FIG. 1) communicates (e.g., over a wired or wireless connection) the microphone output or the output of the feedback control logic 204 or both.

The receive interface logic 210 is configured to receive the transmitted (e.g., whether over a wired or wireless connection) modified audio bitstream (or some signal version thereof). The receive interface logic 210 may be embodied as a wireless audio receiver or a connection (e.g., for wired communication), depending on the manner of communication. The receive interface logic 210 is configured to provide the processed, modified audio bitstream to the audio processing/amplification logic 212, which may include audio decoding functionality, digital to analog converters (DACs), amplifiers, among other components well-known to one having ordinary skill in the art. The audio processing/amplification logic 212 processes the decoded audio having modified parameters and drives the plural speakers 214, enabling the audio to be output. The microphone 216 is configured to receive the audio emanating from the speakers 214, and provide a corresponding signal to the feedback control logic 204. The feedback control logic 204 may determine the signal parameters from the signal provided by the microphone 216, and filtering operations that cause signal adjustments in amplitude, phase, and/or frequency response are applied to the decoded source audio in the audio processing logic 206. The adjustments may be continuous, or almost continuous (e.g., aperiodic depending on conditions of the signal, or periodic, or both).

It should be appreciated within the context of the present disclosure that one or more of the functionality of the various logic illustrated in FIG. 2 may be performed by the mobile device 106, media device 112, or a combination of both, and that in some embodiments, functionality may be combined into fewer logic units or additional logic units.

Figure 3:
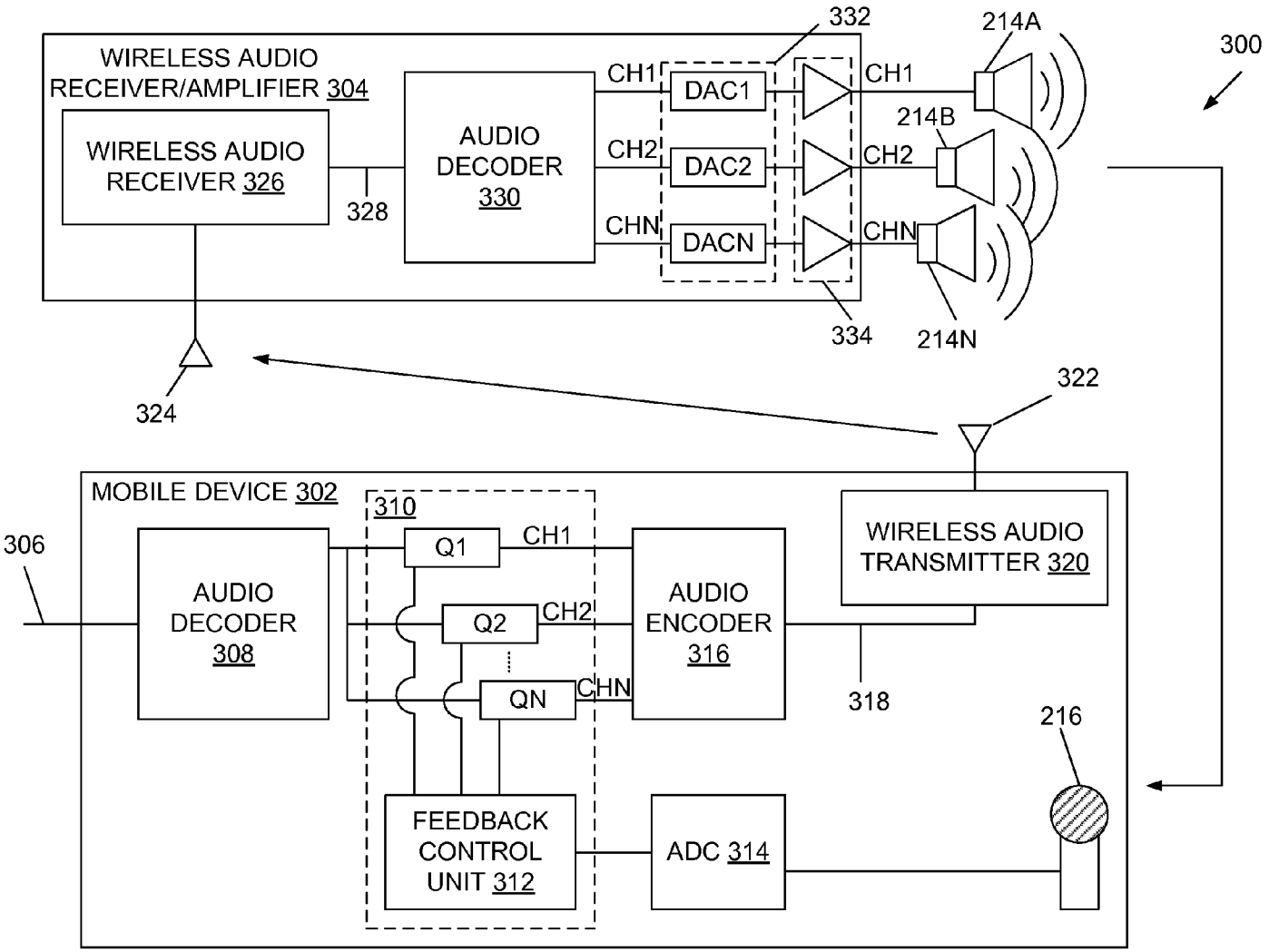
FIG. 3 is a block diagram of an example embodiment of a personal audio beamforming system implemented in a wireless HD environment.

Turning now to FIG. 3, shown is an embodiment of an example personal audio beamforming system 300 that communicates the source audio (or the source audio as adjusted) to a media device. It should be understood by one having ordinary skill in the art that the personal audio beamforming system 300 depicted in FIG. 3 may be implemented using a different system, and hence variations of the system 300 shown in FIG. 3 are contemplated. In some embodiments, the personal audio beamforming system may be embodied in fewer components, or additional components in some embodiments. The personal audio beamforming system 300 comprises a mobile device 302 and a media device configured as a wireless audio receiver/amplifier 304. The mobile device 302 receives a source input over connection 306 at an audio decoder 308. The source input may include audio associated with plural types of media, such as music, television, video, gaming, phones, among other types of media or multimedia. The source input may be generated locally, such as gaming sounds or via sound from a movie from persistent memory (e.g., flash memory), or the source input may be received over a wired or wireless connection from another source. The audio decoder 308 provides decoded source audio to feedback control logic 310. There may be M channels of decoded source audio provided to the feedback control logic 310, where M=1, 2, 3, etc. For instance, the decoded source audio may include stereo sound. In the embodiment depicted in FIG. 3, and for purposes of illustration, assume M=1. The feedback control logic 310 processes (e.g., filters) the decoded sourced audio and provides the processed audio over plural channels (e.g., CH1, CH2, . . . CHN). For instance, the feedback control logic 310 may emphasize the loudness of audio in some locations while making the audio quieter in other locations. The feedback control logic 310 also enables a desired and/or optimized amplitude of desired audio content to be received at the input of the microphone 216 of the mobile device 302. There may be N channels of processed audio provided by the feedback control logic 310, where N is an integer number greater than M. The decoded audio is adjusted by feedback control logic 310, which may be similar to feedback control logic 204 shown in FIG. 2. The feedback control logic 310 includes feedback control unit 312 and filtering functionality that includes respective filters (e.g., Q1, Q2, . . . QN) for the decoded audio channel. Filtering may include linear filtering, non-linear filtering, and/or amplitude and/or phase adjustments. The feedback control unit 312 comprises functionality to evaluate the signal and/or the signal statistics from audio received by the microphone 216. The signal and/or signal statistics may include parameters such as amplitude, phase, frequency response, etc. The filtering function of the feedback control logic 310 involves adjustments to these parameters to enable appropriate beamforming. The feedback control unit 312 adjusts the decoded audio on one or more audio channels based on the parameters, the adjustment including adjustments in amplitude, phase, and/or frequency response. The feedback control logic 310 then communicates the adjusted, decoded audio to an audio encoder 316. In some embodiments, the audio decoder 308 and audio encoder 316 are collectively similar to audio processing 206 shown in FIG. 2. The audio encoder 316 encodes the adjusted, decoded audio and provides a modified audio bitstream over connection 318 to the wireless audio transmitter 320, which includes one or more antennas, such as antenna 322. The wireless audio transmitter 320 communicates (e.g., wirelessly) the modified audio bitstream to a wireless audio receiver 326 residing in the wireless receiver/amplifier 304. In some embodiments, the wireless audio transmitter 320 (including antenna 322) may be embodied as a transceiver, and in some embodiments, is similar to the transmission interface 208 in FIG. 2.

Turning attention now to the wireless receiver/amplifier 304, the wireless audio receiver 326 includes one or more antennas, such as antenna 324. In some embodiments, the wireless audio receiver 326 (including antenna 324) is similar to the receive interface 210 (FIG. 2). The wireless audio receiver 326 receives and processes (e.g., demodulates, filters, amplifies, etc. as is known) the modified audio bitstream and provides the processed output over connection 328 to an audio decoder 330. The audio decoder 330 decodes the modified, decoded audio and provides the decoded audio over a plurality of audio channels (e.g., CH1, CH2, . . . CHN). The decoded audio is processed by digital to analog converter (DAC) logic 332 (which includes plural DACs, though in some embodiments, discrete DACs may be used), amplified by amplifier logic 334 (which includes plural amplifiers, though in some embodiments, discrete amplifiers may be used), and provided to the plural speakers 214 (e.g., 214A, 214B, . . . 214N). In some embodiments, the audio decoder 330, DAC logic 332, and amplifier logic 334 are collectively similar to audio processing/amplification logic 212 in FIG. 2.

The audio output from the plural speakers 214 is received at the microphone 216. The microphone 216 generates a signal based on the audio waves received by the speakers 214, and provides the signal to an analog to digital converter (ADC) 314. In some embodiments, the signal provided by the microphone 216 may already be digitized (e.g., via ADC functionality in the microphone). The digitized signal from the ADC 314 is provided to the feedback control logic 310, where the signal and/or signal statistics are evaluated and adjustments made as described above.

In some embodiments, the adjustments to the decoded source audio may take into account adjustments for other users in the room. For instance, the feedback control logic 310 may emphasize an audio level for the microphone input of the mobile device 302, while also adjusting the decoded source audio in a manner to de-emphasize (e.g., null out or attenuate) the audio emanating from the speakers 214 for another mobile device, such as mobile device 108 (FIG. 1), among others in some embodiments. Such adjustments may represent a balance between a defined or targeted amplitude level for the mobile device 302 and an attenuated amplitude level for the input to the microphone of the mobile device 108.

Explaining further, according to one example operation, assume M=1 (e.g., for an audio voice call), and consider FIG. 1. In this example, N (greater than 1) speakers (e.g., speakers 114) may be used to emphasize audio at a microphone associated with the mobile device 106 while de-emphasizing the audio at a microphone associated with the mobile device 108. In implementations where M=N, for instance 7.1 audio delivered to 7.1 speakers, then the emphasizing/de-emphasizing may be constrained unless down-mixing (e.g., 7.1 to 2) is employed to enable stereo (and also M<N). Better performance may be achieved when M<N, particularly to achieve directionality in the sound reception and emphasizing/de-emphasizing to tailor the audio reception amplitude among plural users in a room.

One or more embodiments of personal audio beamforming systems may be implemented in hardware, software (e.g., including firmware), or a combination thereof. In one embodiment(s), a personal audio beamforming system is implemented with any or a combination of the following technologies, which are all well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc. In some embodiments, one or more portions of a personal audio beamforming system may be implemented in software, where the software is stored in a memory that is executed by a suitable instruction execution system.

Figure 4A:
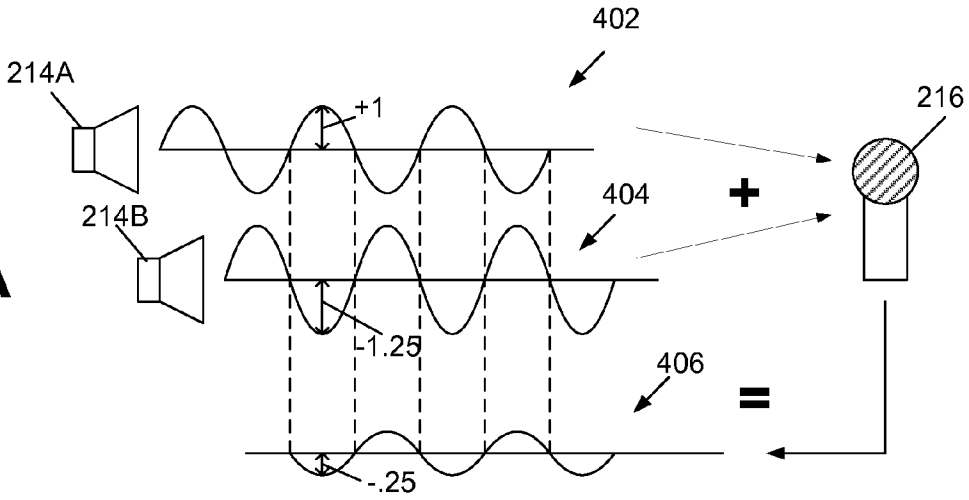
FIGS. 4A-4B are schematic diagrams that conceptually illustrate how signals received at a microphone may be emphasized and de-emphasized in an embodiment of a personal audio beamforming system.
Figure 4B:
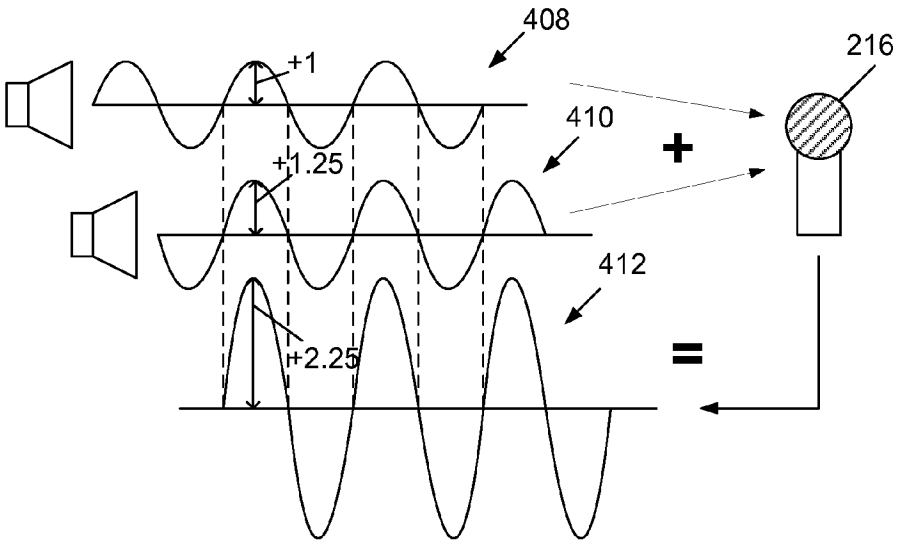

Referring now to FIGS. 4A-4B, shown is a graphic illustration of the effect of the adjustments on the signals received at the microphone 216. It should be appreciated within the context of the present disclosure that FIGS. 4A-4B comprise a conceptual illustration of how different audio levels may be present based on speaker output signal interactions, and that other factors may be involved in practical applications. For instance, note that the signals are shown as sinusoidal for illustrative purposes (e.g., since all signals may be constituted from a plurality of sinusoidal signals), and that other signal waveforms may be present in implementation. Also, as beamforming generally involves delay sum operations using a sub-band approach according to known filtering operations, the illustrations of FIGS. 4A-4B are not intended to suggest that the depicted delays are suitable over a plurality of different frequencies. In FIG. 4A, signals emanating from speakers 214A and 214B are different in phase and amplitude, where the signal 402 has an amplitude of +1 (the value +1, such as +1V, is used merely for illustration, and other values are contemplated) and the signal 404, offset in phase from the signal 402, has an amplitude of −1.25 during the same period of time. These signals 402 and 404, when received at the microphone 216, result in destructive interference at the input to the microphone 216. As noted by the resultant signal 406, the amplitude is reduced to a value of (−) 0.25. In other words, this example represents one mechanism to reduce the amplitude.

Referring to FIG. 4B, constructive interference is represented, with the signals 408 and 410 having like phase and hence amplitudes that combine (+1+1.25) to achieve an increased amplitude of 2.25 as shown in signal 412. In other words, adjustments to increase the signal input to the microphone 216 may be achieved in this fashion.

Figure 5:
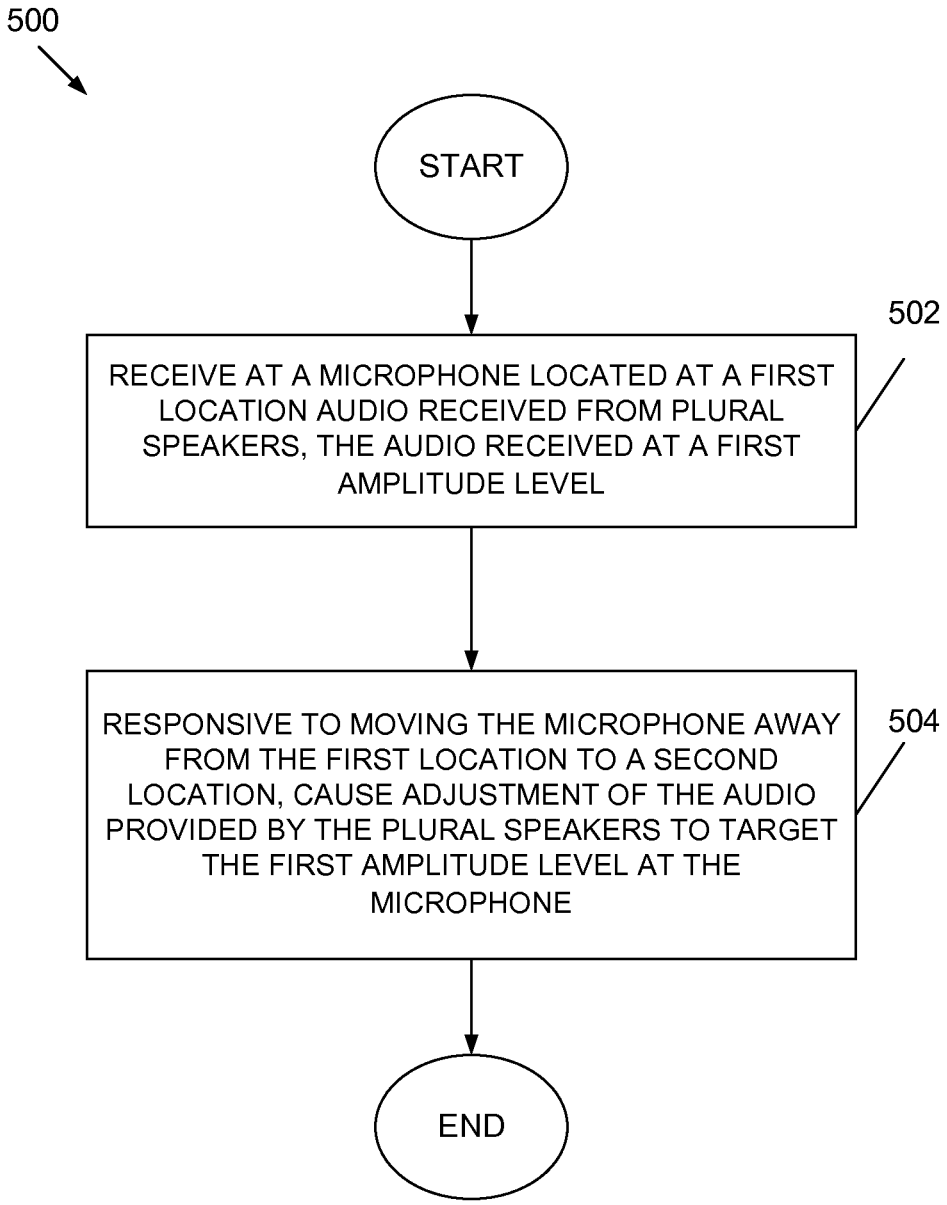
FIG. 5 is a flow diagram that illustrates one embodiment of a personal audio beamforming method.

In view of the above description, it should be appreciated that one embodiment of a personal audio beamforming method, shown in FIG. 5 and referred to as method 500, includes receiving at a microphone located at a first location audio received from plural speakers, the audio received at a first amplitude level (502). The method 500 also includes, responsive to moving the microphone away from the first location to a second location, causing adjustment of the audio provided by the plural speakers to target the first amplitude level at the microphone (504). The method 500 may also include receiving the audio at the microphone at the second location, and causing adjustment of the audio provided by the plural speakers to null or generally de-emphasize the audio at a second microphone located at a third location different than the first and second location. Some embodiments of the method 500 include causing by adjusting (e.g., continuously, or aperiodically or periodically in some embodiments) audio amplitude, phase, frequency response, or any combination of these parameters. In some embodiments, the targeted level may be a maximum amplitude level.

Any process descriptions or blocks in flow diagrams should be understood as representing modules, segments, or portions of code which include one or more executable instructions for implementing specific logical functions or steps in the process, and alternate implementations are included within the scope of the disclosure in which functions may be executed out of order from that shown or discussed, including substantially concurrently or in reverse order, depending on the functionality involved, as would be understood by those reasonably skilled in the art.

It should be emphasized that the above-described embodiments of the present disclosure are merely possible examples of implementations, merely set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

At least the following is claimed:

1. A system, comprising:

a microphone;

feedback control logic configured to perform adaptive audio beamforming to cause audio provided by a plurality of speakers to be perceived loudest at a location of the microphone as the microphone is moved to a plurality of different locations; and an audio decoder configured to generate a decoded audio, wherein the feedback control logic is configured to cause, based on an amplitude level of an audio received at the microphone from the plurality of speakers, adjustments of one or more parameters in the decoded audio that is encoded and transmitted to a media device.

2. The system of claim 1, wherein the audio decoder is configured to receive sourced audio from a media source and provide the decoded audio among a plurality of different audio channels.

3. The system of claim 2, wherein the feedback control logic comprises filtering functionality configured to cause the adjustments to the one or more parameters.

4. The system of claim 2, further comprising:

an encoder configured to encode the adjusted parameters and the decoded audio to provide a modified audio bitstream, the encoder configured to communicate the modified audio bitstream according to a communicated signal.

5. The system of claim 4, further comprising a transmitter, wherein the microphone, the feedback control logic, the audio decoder, the encoder, and the transmitter reside in a mobile device, wherein the transmitter is configured to communicate the signal to the media device that is separate from the mobile device.

6. The system of claim 5, wherein the media device is configured to provide the audio received at the microphone through the plurality of speakers that correspond to different audio channels based on the signal.

7. The system of claim 4, further comprising a transmitter, wherein the microphone and the transmitter resides in a mobile device and the feedback control logic and the audio decoder reside in the media device that is separate from the mobile device, wherein the transmitter is configured to communicate the amplitude level at the microphone to the media device.

8. The system of claim 7, wherein the media device is configured to provide the audio received at the microphone through the plurality of speakers that correspond to different audio channels based on the signal.

9. The system of claim 1, wherein the audio received at the microphone is based on constructive interference, destructive interference, or a combination of both.

10. The system of claim 1, wherein the microphone resides in a mobile device, and further comprising a second mobile device comprising a second microphone, wherein the feedback control logic is configured to de-emphasize the amplitude of the audio received at the microphone that also is within range of the second microphone.

11. A method, comprising:

receiving at a microphone located at a first location audio received from plural speakers;

configuring a feedback control logic to perform adaptive audio beamforming to cause audio received at the microphone from the plural speakers to be perceived loudest responsive to moving the microphone away from the first location to a second location;

configuring an audio decoder to generate a decoded audio; and configuring the feedback control logic to cause, based on an amplitude level of the audio received at the microphone from the plural speakers, adjustment of one or more parameters in the decoded audio that is transmitted to a media device after being encoded.

12. The method of claim 11, further comprising, while receiving the audio at the microphone at the second location, causing adjustment of the audio provided by the plural speakers to null the audio at a second microphone located at a third location different than the first and second location.

13. The method of claim 11, wherein causing adjustment of the audio provided by the plural speakers comprises adjusting audio amplitude, phase, frequency response, or a combination of both.

14. The method of claim 11, wherein causing adjustment of the audio provided by the plural speakers is performed continuously.

15. The method of claim 11, wherein the audio is distributed among plural audio channels.

16. The method of claim 11, wherein the amplitude level is a maximum amplitude level.

17. A system, comprising:

a mobile device comprising:

a microphone;

an audio decoder configured to generate a decoded audio;

feedback control logic configured to perform adaptive audio beamforming to cause audio received at the microphone from plural speakers to be perceived loudest at a location of the microphone as the microphone is moved to a plurality of different locations by causing adjustments of one or more parameters in the decoded audio based on an amplitude level of the audio received at the microphone from the plural speakers; and an audio encoder configured to provide a modified audio bitstream using the decoded audio and the adjusted one or more parameters.

18. The system of claim 17, wherein the mobile device comprises a wireless audio transmitter configured to transmit the modified audio bitstream as a signal.

19. The system of claim 18, further comprising a second device in wireless communication with the mobile device, the second device comprising:

a wireless audio receiver configured to receive the signal and provide an audio bitstream;

another audio decoder configured to decode the audio bitstream and provide decoded audio among a plurality of channels;

plural digital to analog converters configured to digitize decoded audio;

plural amplifiers configured to amplify the digitized decoded audio; and the plural speakers configured to provide the audio to the microphone based on constructive interference, destructive interference, or a combination of both.

20. The system of claim 19, wherein the second device is configured to provide the audio received at the microphone through the plural speakers corresponding to different audio channels based on the signal.

* * * * *